US010857788B2

(12) United States Patent
Arakane et al.

(10) Patent No.: US 10,857,788 B2
(45) Date of Patent: Dec. 8, 2020

(54) INK-JET RECORDING APPARATUS

(71) Applicant: Brother Kogyo Kabushiki Kaisha, Nagoya (JP)

(72) Inventors: Satoru Arakane, Nagoya (JP); Shota Iida, Nagoya (JP); Tomohiro Nodsu, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/664,375

(22) Filed: Oct. 25, 2019

(65) Prior Publication Data

US 2020/0061989 A1 Feb. 27, 2020

Related U.S. Application Data

(63) Continuation of application No. PCT/JP2018/016966, filed on Apr. 26, 2018.

(30) Foreign Application Priority Data

Apr. 28, 2017 (JP) ..... 2017-089276

(51) Int. Cl.
*B41J 2/045* (2006.01)

(52) U.S. Cl.
CPC ..... *B41J 2/04571* (2013.01); *B41J 2/0458* (2013.01); *B41J 2/04588* (2013.01); *B41J 2/04591* (2013.01)

(58) Field of Classification Search
CPC .. B41J 2/04503; B41J 2/04571; B41J 2/0458; B41J 2/04588; B41J 2/0459; B41J 2/04591; B41J 2/195; B41J 2/175
See application file for complete search history.

(56) References Cited

U.S. PATENT DOCUMENTS 5,281,980 A * 1/1994 Kishida ..... B41J 2/04528 347/13
6,068,363 A * 5/2000 Saito ..... B41J 2/04541 347/17

(Continued)

FOREIGN PATENT DOCUMENTS

JP 2003-276179 A 9/2003
JP 2006-166092 A 6/2006

(Continued)

OTHER PUBLICATIONS

Jul. 17, 2018—International Search Report—Intl App PCT/JP2018/016966.

(Continued)

*Primary Examiner* — Anh T Vo
(74) *Attorney, Agent, or Firm* — Banner & Witcoff, Ltd.

(57) ABSTRACT

An ink-jet recording apparatus, including: a recording head including a first nozzle communicating with a first chamber storing a first ink and a second nozzle communicating with a second chamber storing a second ink whose viscosity change rate differs from the first ink; and a controller configured to determine a drive voltage to be a first voltage and determine voltage application timings for the respective first and second nozzles to be a first timing when estimated viscosity of the first ink is lower than a first viscosity and to determine the drive voltage to be a second voltage higher than the first voltage, determine the voltage application timing for the first nozzle to be the first timing, and determine the voltage application timing for the second nozzle to be a second timing different from the first timing when the estimated viscosity is equal to or higher than the first viscosity.

10 Claims, 8 Drawing Sheets

| VISCOSITY VALUE | TARGET VOLTAGE VALUE | EJECTION TIMING INFORMATION (enc) | | | |
|---|---|---|---|---|---|
| | | Bk | M | C | Y |
| VISCOSITY 1 | 24V | 0 | 0 | 0 | 0 |
| VISCOSITY 2 | 25V | 0 | +1 | +2 | +2 |
| VISCOSITY 3 | 26V | 0 | +2 | +4 | +4 |

(56) References Cited

U.S. PATENT DOCUMENTS

| | | | | |
|---|---|---|---|---|
| 6,435,668 | B1 * | 8/2002 | Barbour | B41J 2/04528 347/60 |
| 6,708,279 | B1 * | 3/2004 | Takenaka | G06F 1/3203 713/324 |
| 7,438,376 | B2 * | 10/2008 | Tamura | B41J 2/04541 347/17 |
| 8,109,589 | B2 | 2/2012 | Matsushita | |
| 2008/0094446 | A1 | 4/2008 | Sheahan et al. | |
| 2009/0167794 | A1 | 7/2009 | Hosono et al. | |
| 2010/0091061 | A1 | 4/2010 | Matsushita | |
| 2016/0107440 | A1 | 4/2016 | Kanzawa | |

FOREIGN PATENT DOCUMENTS

| | | | |
|---|---|---|---|
| JP | 2009-160920 | A | 7/2009 |
| JP | 2010-094808 | A | 4/2010 |
| JP | 2011-131493 | A | 7/2011 |
| JP | 2016-221847 | A | 12/2016 |
| JP | 2017-061131 | A | 3/2017 |
| WO | 2013/006152 | A1 | 1/2013 |

OTHER PUBLICATIONS

Oct. 29, 2019—(WO) International Preliminary Report on Patentability—App PCT/JP2018/016966, Eng Tran.
Aug. 3, 2020—(CN) Notification of First Office Action—App CN201880027472.2.

* cited by examiner

FIG.5A

| VISCOSITY VALUE | TARGET VOLTAGE VALUE | EJECTION TIMING INFORMATION (enc) | | | |
|---|---|---|---|---|---|
| | | Bk | M | C | Y |
| VISCOSITY 1 | 24V | 0 | 0 | 0 | 0 |
| VISCOSITY 2 | 25V | 0 | +1 | +2 | +2 |
| VISCOSITY 3 | 26V | 0 | +2 | +4 | +4 |

FIG.5B

| DISCHARGE-TIME INFORMATION | THE NUMBER OF PAGES | ENVIRONMENTAL TEMPERATURE VALUE |
|---|---|---|
| 2017/03/31 16:58 | 3 PAGES | 14℃ |
| 2017/04/03 09:31 | 15 PAGES | 16℃ |
| ⋮ | ⋮ | ⋮ |
| 2017/04/28 11:46 | 2 PAGES | 19℃ |

INK-JET RECORDING APPARATUS

CROSS REFERENCE TO RELATED APPLICATION

The present application is a continuation application of International Application No. PCT/JP2018/016966, filed on Apr. 26, 2018, which claims priority to Japanese Patent Application No. 2017-089276, filed on Apr. 28, 2017. The contents of these applications are incorporated by in their entirety.

BACKGROUND

Technical Field

The following disclosure relates to an ink-jet recording apparatus configured to record an image on a sheet.

Description of Related Art

It is conventionally known that an ink-jet recording apparatus configured to record an image on a sheet by ejecting ink may experience a phenomenon in which particles of pigment ink stored in an ink tank settle down with time and the viscosity of the ink thereby changes. To address such a phenomenon, the ink-jet recording apparatus is configured to increase ejection energy with an increase in the viscosity of the ink for making an ink ejection amount constant.

SUMMARY

A recent study has revealed that the change in the viscosity of the ink influences not only the ink ejection amount but also a speed of ejection of the ink from nozzles. Further, a new issue has been found that the ink lands on a position that deviates from a target position on a sheet in the case where the ejection speed of the ink changes.

Accordingly, one aspect of the present disclosure is directed to an ink-jet recording apparatus configured to appropriately adjust, for each of different inks, a deviation of an ink landing position from a target position caused by the change in the viscosity.

In one aspect of the present disclosure, an ink-jet recording apparatus includes: a recording head including (a) nozzles each of which communicates with a corresponding one of storage chambers that respectively store inks and (b) energy generating elements each of which generates an ejection energy for causing the ink stored in a corresponding one of the storage chambers to be ejected through a corresponding one of the nozzles; a carriage on which the recording head is mounted and which reciprocatingly moves in a main scanning direction; a power supply circuit configured to hold a drive voltage which is common to all of the energy generating elements and which is to be applied to each of the energy generating elements for generating the ejection energy; and a controller, wherein the storage chambers include a first storage chamber storing a first ink and a second storage chamber storing a second ink, a rate of change in a viscosity of the second ink being different from a rate of change in a viscosity of the first ink, wherein the nozzles include a first nozzle communicating with the first storage chamber and a second nozzle communicating with the second storage chamber, wherein the controller executes: an estimating process to estimate the viscosity of the first ink stored in the first storage chamber; a determining process to determine, based on the viscosity estimated in the estimating process, a voltage value of the drive voltage held by the power supply circuit and a timing of application of the drive voltage to each of the energy generating elements for causing the ink to land on a target position of a sheet; a drive-voltage raising process to raise the drive voltage held by the power supply circuit to the voltage value determined in the determining process; and an ejecting process to apply, to each of the energy generating elements, the drive voltage raised in the drive-voltage raising process at the timing determined in the determining process during the movement of the carriage in the main scanning direction, wherein, in the determining process, when the viscosity estimated in the estimating process is lower than a first viscosity, the controller determines the voltage value of the drive voltage to be a first voltage value and determines the timing of application of the drive voltage to the energy generating element corresponding to the first nozzle and the timing of application of the drive voltage to the energy generating element corresponding to the second nozzle to be a first timing, and when the viscosity estimated in the estimating process is equal to or higher than the first viscosity, the controller determines the voltage value of the drive voltage to be a second voltage value higher than the first voltage value, determines the timing of application of the drive voltage to the energy generating element corresponding to the first nozzle to be the first timing, and determines the timing of application of the drive voltage to the energy generating element corresponding to the second nozzle to be a second timing different from the first timing.

In another aspect of the present disclosure, an ink-jet recording apparatus includes: a recording head including (a) nozzles each of which communicates with a corresponding one of storage chambers that respectively store inks and (b) energy generating elements each of which generates ejection energy for causing the ink stored in a corresponding one of the storage chambers to be ejected through a corresponding one of the nozzles; a carriage on which the recording head is mounted and which reciprocatingly moves in a main scanning direction; a power supply circuit configured to hold a drive voltage which is common to all of the energy generating elements and which is to be applied to each of the energy generating elements for generating the ejection energy; and a controller, wherein the storage chambers include a first storage chamber storing a first ink and a second storage chamber storing a second ink, a rate of change in a viscosity of the second ink being lower than a rate of change in a viscosity of the first ink, wherein the nozzles include a first nozzle communicating with the first storage chamber and a second nozzle communicating with the second storage chamber, wherein the controller executes: an estimating process to estimate the viscosity of the first ink stored in the first storage chamber; a determining process to determine, based on the viscosity estimated in the estimating process, a voltage value of the drive voltage held by the power supply circuit and a timing of application of the drive voltage to each of the energy generating elements for causing the ink to land on a target position of a sheet; a drive-voltage raising process to raise the drive voltage held by the power supply circuit to the voltage value determined in the determining process; and an ejecting process to apply, to each of the energy generating elements, the drive voltage raised in the drive-voltage raising process at the timing determined in the determining process during the movement of the carriage in the main scanning direction, wherein, in the determining process, when the viscosity estimated in the estimating process is lower than a first viscosity, the controller determines the voltage value of the drive voltage to be a first voltage value and determines the timing of application of the drive voltage to the energy generating element corresponding to the first nozzle and the timing of application of the drive voltage to the energy generating element corresponding to the second nozzle to be a first timing, and when the viscosity estimated in the estimating process is equal to or higher than the first viscosity, the controller determines the voltage value of the drive voltage to be equal to a second voltage value higher than the first voltage value, determines the timing of application of the drive voltage to the energy generating element corresponding to the first nozzle to be a second timing earlier than the first timing, and determines the timing of application of the drive voltage to the energy generating element corresponding to the second nozzle to be a third timing later than the first timing.

BRIEF DESCRIPTION OF THE DRAWINGS

The objects, features, advantages, and technical and industrial significance of the present disclosure will be better understood by reading the following detailed description of an embodiment, when considered in connection with the accompanying drawings, in which:

FIGS. 1A and 1B are external perspective views of a printer according to one embodiment, FIG. 1A illustrating a state in which a cover is closed while FIG. 1B illustrates a state in which the cover is open;

FIGS. 5A and 5B illustrate examples of data stored in an EEPROM, FIG. 5A illustrating an ejection condition table, FIG. 5B illustrating a history list;

DETAILED DESCRIPTION OF THE EMBODIMENT

Figure 1A:
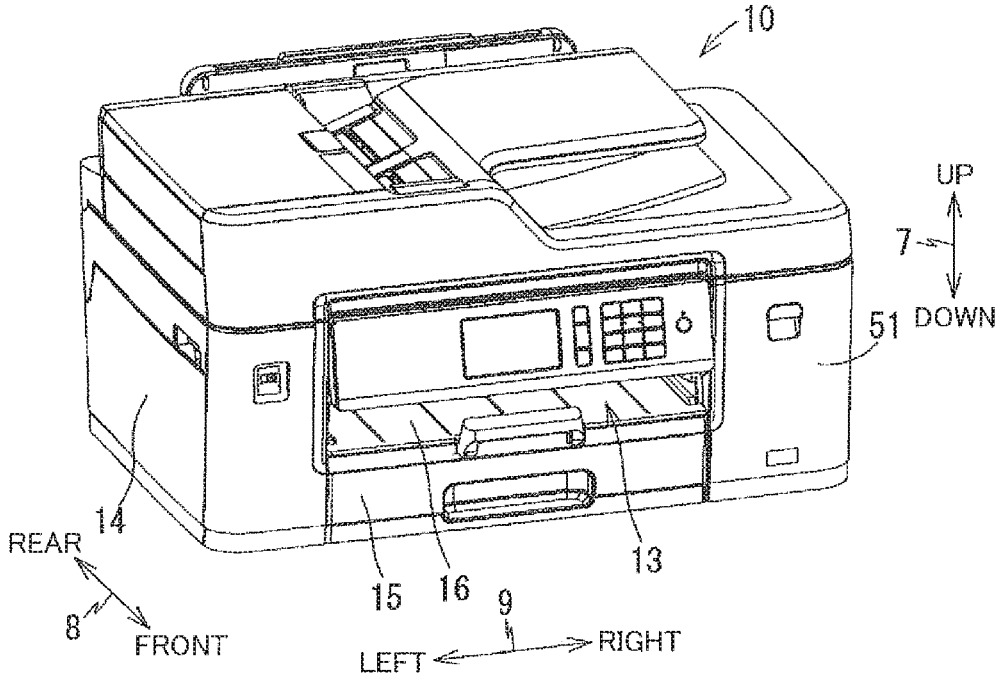

Referring to the drawings, there will be hereinafter explained a printer 10 according to one embodiment of the present disclosure. It is to be understood that the following embodiment is described only by way of example, and the disclosure may be otherwise embodied with various modifications without departing from the scope of the disclosure. An up-down direction 7 is defined with respect to an attitude of the printer 10 placed horizontally in its operative position as shown in FIG. 1A. (The attitude of the printer 10 shown in FIG. 1 may be referred to as "use attitude" where appropriate.) A front-rear direction 8 is defined regarding a side of the printer 10 on which an opening 13 is formed as a front side, and a right-left direction 9 is defined in a state in which the printer 10 is seen from the front side. In the use attitude of the printer 10, the up-down direction 7 corresponds to the vertical direction, and the front-rear direction 8 and the right-left direction 9 both correspond to the horizontal direction. The front-rear direction 8 and the right-left direction 9 are orthogonal to each other.

Overview of Printer 10

The printer 10 according to the present embodiment is one example of an ink-jet recording apparatus configured to record an image on a sheet 12 (FIG. 2) according to an ink-jet recording method. The printer 10 includes a housing 14 having a generally rectangular parallelepiped shape. As shown in FIGS. 1 and 2, the printer 10 includes a sheet-supply tray 15, a supply roller 23, conveyance rollers 25, a recording portion 30, a platen 26 opposed to the recording portion 30, discharge rollers 27, a sheet-discharge tray 16, and a cartridge holder 50 on which four cartridges 60 are removably mounted.

The printer 10 causes a conveyance motor 102 (FIG. 4) to drive the supply roller 23 and the conveyance rollers 25 such that the sheet 12 supported on the sheet-supply tray 15 is conveyed onto the platen 26. The printer 10 subsequently causes the recording portion 30 to eject ink stored in each cartridge 60 toward the sheet 12 supported on the platen 26. Thus, an image is recorded on the sheet 12. The printer 10 then causes the conveyance motor 102 to drive the discharge rollers 27 such that the sheet 12 on which the image has been recorded is discharged to the sheet-discharge tray 16.

Recording Portion 30

Figure 2:
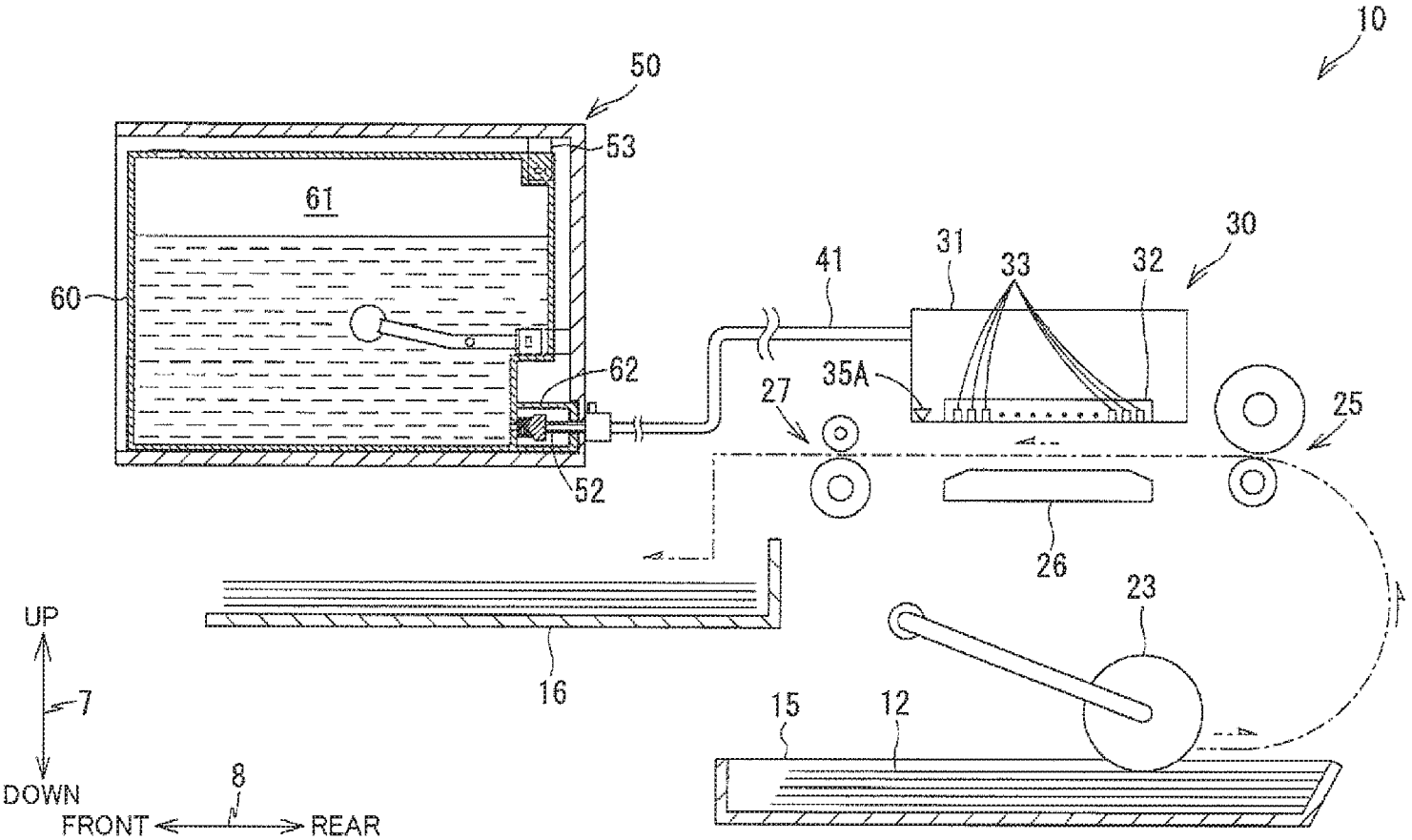
FIG. 2 is a cross-sectional view schematically illustrating an inner structure of the printer.
Figure 3:
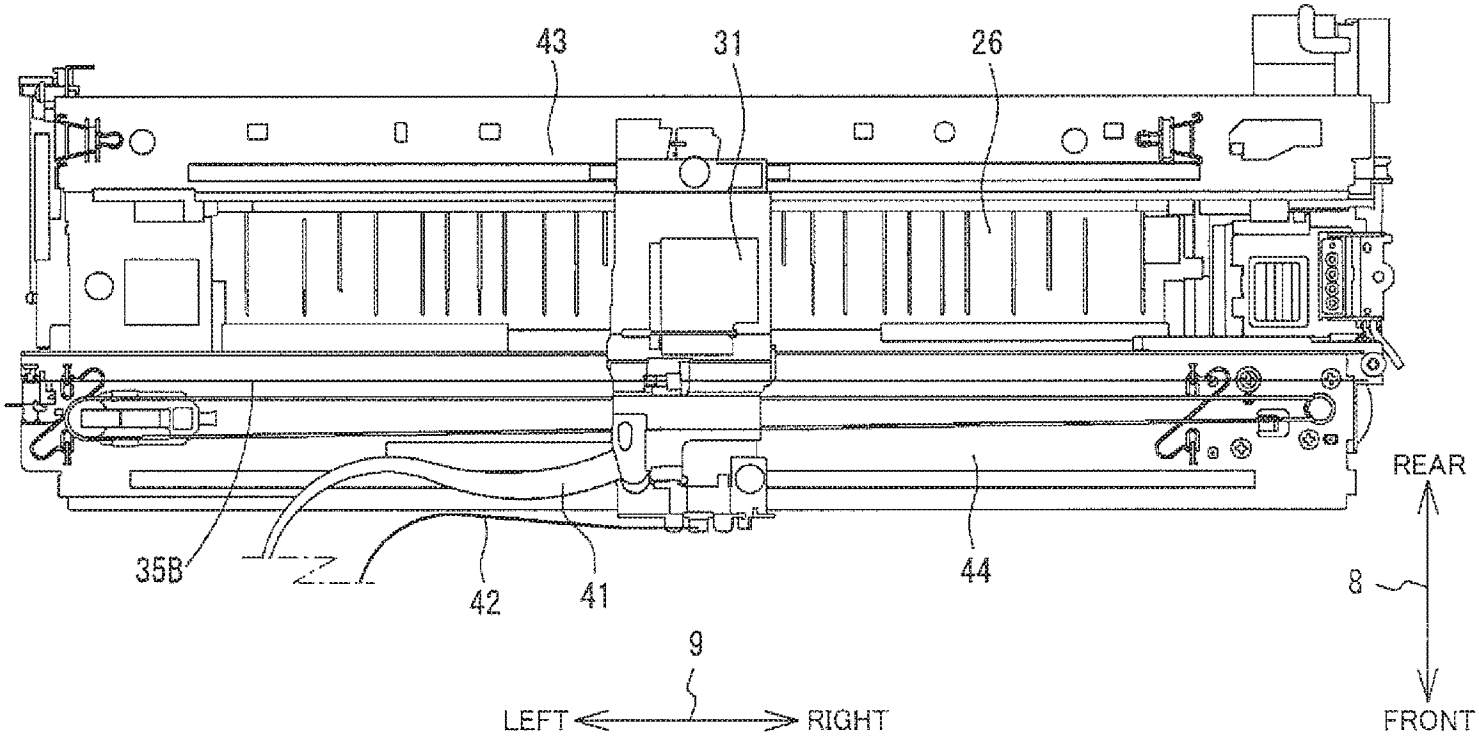
FIG. 3 is a plan view of a carriage and guide rails.

As shown in FIG. 2, the recording portion 30 is disposed between the conveyance rollers 25 and the discharge rollers 27. The recording portion 30 is disposed so as to be opposed to the platen 26 in the up-down direction 7. The recording portion 30 includes a carriage 31, a recording head 32, and an encoder sensor 35A. As shown in FIG. 3, four ink tubes 41 and a flexible flat cable 42 are connected to the carriage 31. Each of the four ink tubes 41 supplies the ink stored in a corresponding one of the four cartridges 60 to the recording head 32. The flexible flat cable 42 electrically connects the recording head 32 and a control board on which a controller 130 (FIG. 4) is mounted.

Figure 4:
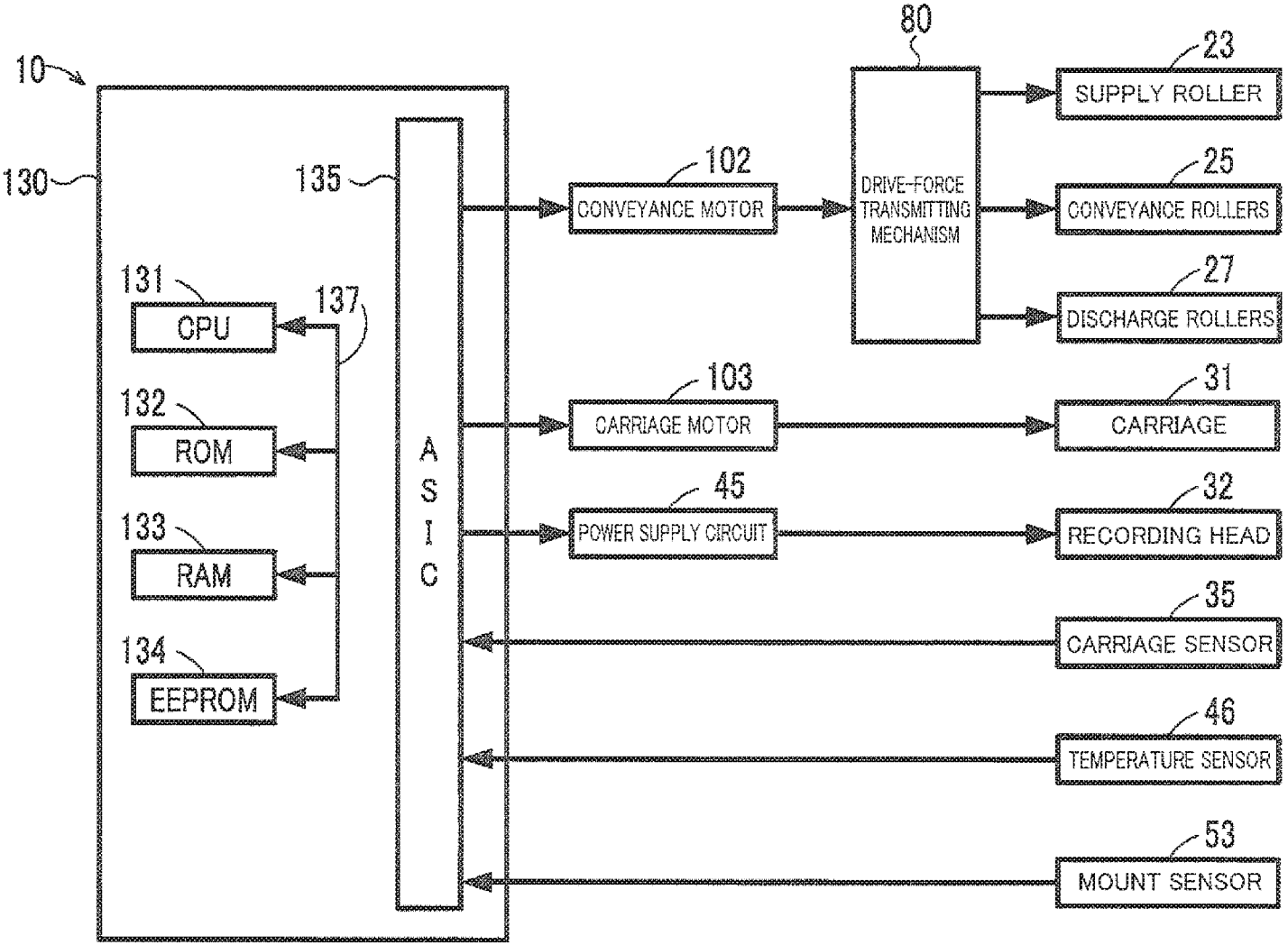
FIG. 4 is a block diagram of the printer.

As shown in FIG. 3, the carriage 31 is supported by guide rails 43, 44 spaced apart from each other in the front-rear direction 8 and each extending in the right-left direction 9. The carriage 31 is coupled to a known belt mechanism provided on the guide rail 44. The belt mechanism is driven by a carriage motor 103 (FIG. 4). That is, the carriage 31 is reciprocated in the right-left direction 9 (as one example of a main scanning direction) over a region in which the carriage 31 is opposed to the platen 26, by the belt mechanism that is rotated by a drive force of the carriage motor 103.

As shown in FIG. 2, the recording head 32 is mounted on the carriage 31. A plurality of nozzles 33 are formed in a lower surface of the recording head 32 (hereinafter referred to as "nozzle surface" where appropriate). The recording head 32 includes a plurality of drive elements corresponding to the respective nozzles 33. That is, the recording head 32 includes a plurality of sets of the nozzle 33 and the drive element. The drive elements are vibrated by a drive voltage applied thereto from a power supply circuit 45 (which will be explained) so as to cause ink droplets to be ejected from the corresponding nozzles 33.

Each of the drive elements is one example of an energy generating element that generates energy for causing the ink droplets to be ejected from the corresponding nozzle 33, i.e., vibration energy, utilizing the drive voltage applied from the power supply circuit 45. It is noted, however, that the energy generating element may be a heater that generates thermal energy, for instance. In this case, the heater may heat ink by the thermal energy generated by utilizing the drive voltage applied by the power supply circuit 45, so as to cause droplets of bubbled ink to be ejected from the nozzle 33.

The power supply circuit 45 is a circuit to hold the drive voltage for vibrating the drive elements. The power supply circuit 45 is a known electric circuit including a regulator circuit for raising a power supply voltage supplied from an external power source to a desired voltage value and a condenser or capacitor for holding the voltage raised by the regulator circuit. The power supply circuit 45 is configured to hold the drive voltage that is common to all of the drive elements mounted on the recording head 32. In other words, the power supply circuit 45 includes only one capacitor for holding the drive voltage to be applied to all of the drive elements. In other words, the power supply circuit 45 applies the same drive voltage to all of the drive elements.

Figure 8:
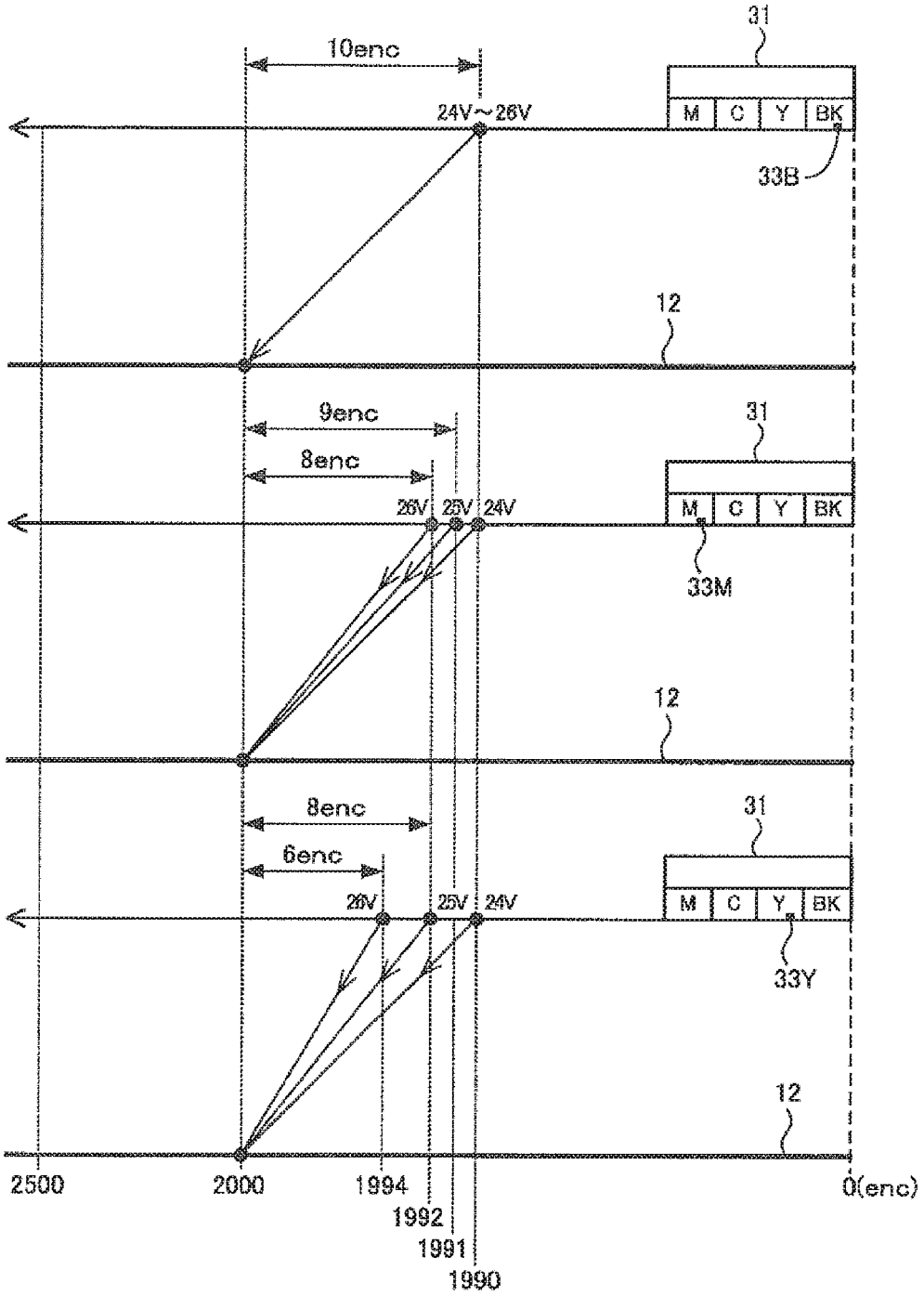
FIG. 8 is a diagram indicating ejection timings respectively for black ink nozzles, magenta ink nozzles, and yellow ink nozzles at various drive voltages.

The nozzles 33 are arranged in the front-rear direction 8 and the right-left direction 9. The nozzles 33 arranged in one row in the front-rear direction 8 (hereinafter referred to as "nozzle row" where appropriate) eject ink droplets of the same color. There are formed, in the nozzle surface, twenty-four nozzle rows that are arranged in the right-left direction 9. The twenty-four nozzle rows are classified into four groups each constituted by neighboring six rows, and the nozzles 33 in the same group eject ink droplets of the same color. As shown in FIG. 8, six nozzle rows in the rightmost group eject droplets of black ink, another six nozzle rows in the second group next to the rightmost group eject droplets of yellow ink, still another six nozzle rows in the third group next to the second group eject droplets of cyan ink, and yet another six nozzle rows in the leftmost group eject droplets of magnet ink.

Among the nozzles 33 shown in FIG. 8, each of the nozzles 33B from which the black ink is ejected is one example of a first nozzle. Each of the nozzles 33M from which the magenta ink is ejected is one example of a second nozzle. Each of the nozzles 33C (not shown) from which the cyan ink is ejected and each of the nozzles 33Y from which the yellow ink is ejected are one example of a third nozzle. It is noted, however, that the number of nozzle rows and the color combination of inks to be ejected are not limited to those of the embodiment.

As shown in FIG. 3, the guide rail 44 is provided with a band-like encoder strip 35B extending in the right-left direction 9. The encoder sensor 35A is mounted on the lower surface of the carriage 31 at a position at which the encoder sensor 35A faces the encoder strip 35B. During the reciprocating movement of the carriage 31, the encoder sensor 35A reads the encoder strip 35B so as to generate pulse signals and outputs the generated pulse signals to the controller 130. The encoder sensor 35A and the encoder strip 35B constitute a carriage sensor 35 (FIG. 4).

Cartridge Holder 50

Figure 1B:
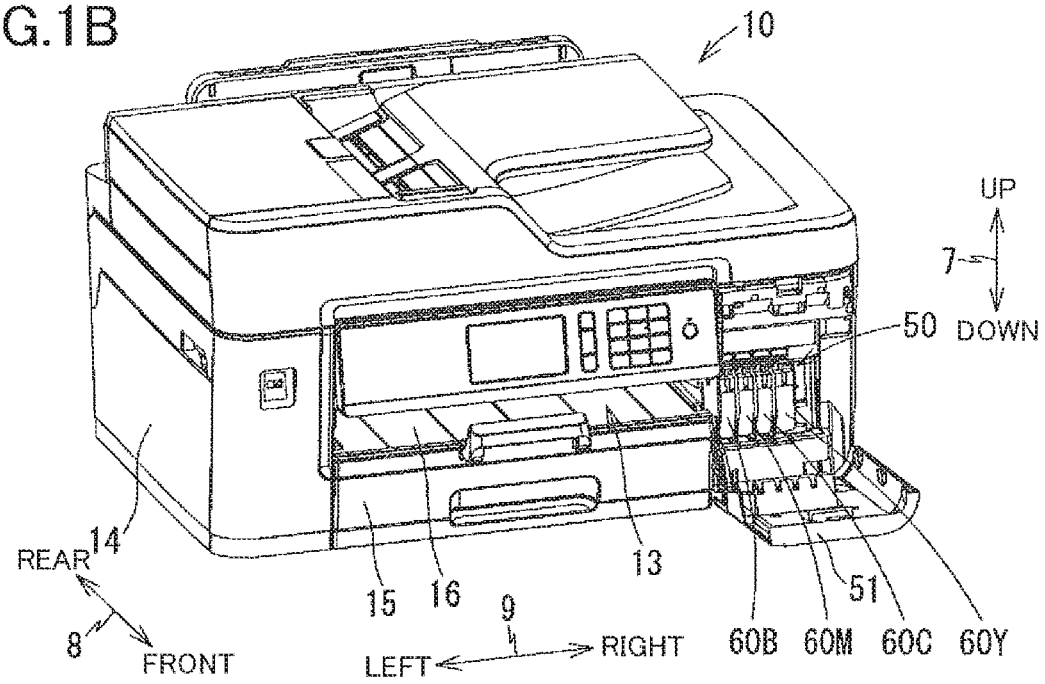

As shown in FIG. 1, the cartridge holder 50 is covered by a cover 51 provided on the front surface of the housing 14 at a right end portion thereof in the right-left direction 9 (FIG. 1A) or the cartridge holder 50 is exposed (FIG. 1B) when not covered. When the cover 51 is opened as shown in FIG. 1B, an inner space of the cartridge holder 50 is exposed to an exterior of the printer 10. The cartridge holder 50, on which a plurality of cartridges 60B, 60M, 60C, 60Y (hereinafter each referred to as a cartridge 60 where appropriate) are removably mounted, includes four ink needles 52 and four mount sensors 53 for the respective four cartridges 60B, 60M, 60C, 60Y.

Each ink needle 52 is a tube in which a flow path is formed. The ink needle 52 is provided at a lower portion of the inner space of the cartridge holder 50 so as to protrude frontward from an end wall of the cartridge holder 50 that partially defines the inner space. One of opposite ends of the ink needle 52, i.e., a protruding distal end of the ink needle 52, is open. The other of the opposite ends of the ink needle 52 communicates with the recording head 32 through the corresponding ink tube 41.

Each mount sensor 53 is configured to detect whether the corresponding cartridge 60 is mounted on the cartridge holder 50. Each mount sensor 53 includes a light emitting portion and a light receiving portion spaced apart from each other in the right-left direction 9. Each of the cartridges 60 mounted on the cartridge holder 50 is located between the light emitting portion and the light receiving portion of the corresponding mount sensor 53. In other words, the light emitting portion and the light receiving portion of the mount sensor 53 are located so as to be opposed to each other with the corresponding cartridge 60 mounted on the cartridge holder 50 interposed therebetween. A region of each cartridge 60 located between the light emitting portion and the light receiving portion when mounted on the cartridge holder 50 is formed of a material or has a color that blocks the light emitted from the light emitting portion.

Each mount sensor 53 is configured to output, to the controller 130, different mount signals depending on whether the light emitted from the light emitting portion in the right-left direction 9 is received by the light receiving portion. For instance, the mount sensor 53 outputs a low-level signal to the controller 130 in the case whether the intensity of the light received by the light receiving portion is less than threshold intensity, that is, in the case where the corresponding cartridge 60 is mounted on the cartridge holder 50. On the other hand, the mount sensor 53 outputs, to the controller 130, a high-level signal whose signal intensity is higher than the low-level signal in the case where the intensity of the light received by the light receiving portion is equal to or larger than the threshold intensity, that is, in the case where the corresponding cartridge 60 is not mounted on the cartridge holder 50.

Cartridges 60

As shown in FIG. 2, each of the cartridges 60 includes an ink chamber 61 and an ink supply portion 62. The ink chamber 61 is one example of a storage chamber for storing the ink. The ink supply portion 62 supplies the ink stored in the ink chamber 61 to an exterior of the cartridge 60. The ink supply portion 62 is provided at a lower portion of the cartridge 60 so as to protrude, in a direction in which the cartridge 60 is inserted into the inner space of the cartridge holder 50, from the front surface of the cartridge that faces the inner space when the cartridge 60 is inserted into the cartridge holder 50. The ink supply portion 62 protrudes from the surface of the cartridge 60 in the insertion direction. One of opposite ends, i.e., a protruding distal end, of the ink supply portion 62 is open while the other of the opposite ends of the ink supply portion 62 communicates with the ink chamber 61.

When each cartridge 60 is inserted into the cartridge holder 50, the ink needle 52 enters an inner space of the ink supply portion 62, so that the ink stored in the ink chamber 61 is supplied to the recording head 32 via the inner space of the ink supply portion 62, an inner space of the ink needle 52, and the ink tube 41. That is, when the cartridge 60 is mounted on the cartridge holder 50, the ink chamber 61 of the cartridge 60 is brought into communication with the corresponding nozzles 33.

The cartridges 60B, 60M, 60C, 60Y respectively store inks of mutually different colors. Specifically, the cartridge 60B stores the black ink, the cartridge 60M stores the magenta ink, the cartridge 60C stores the cyan ink, and the cartridge 60Y stores the yellow ink. Each of the inks stored in the respective cartridges 60 is a mixture composed of a solvent that contains water as a major component and a colorant dispersed in the solvent. The colorants for the respective inks of mutually different colors differ from each other in composition. Each colorant contains a granular pigment as a major component, for instance. In the case where the cartridge 60 is left for a long period, separation of the solvent and the colorant occurs, causing a phenomenon in which the colorant settles down at the bottom of the cartridge 60. This phenomenon will be hereinafter referred to as sedimentation.

The viscosity of the ink that suffers from sedimentation becomes non-uniform in the ink chamber 61. That is, the viscosity of the ink is higher at a lower portion of the ink chamber 61, and the viscosity of the ink is lower at an upper portion of the ink chamber 61. In the present printer 10, the ink supply portion 62 is provided at the lower portion of the cartridge 60. Accordingly, as the sedimentation proceeds, the viscosity of the ink to be supplied to the recording head 32 becomes higher. Further, a rate of sedimentation, namely, a rate of change in ink viscosity, differs depending on the ink composition. For instance, the rate of sedimentation of the black ink is the highest among the four inks, the rate of sedimentation of the magenta ink is lower than that of the black ink, and the rate of sedimentation of the cyan ink and the yellow ink is lower than that of the magenta ink.

The black ink is one example of a first ink, the magenta ink is one example of a second ink, each of the cyan ink and the yellow ink is one example of a third ink. The ink chamber 61 of the cartridge 60B is one example of a first storage chamber, the ink chamber 61 of the cartridge 60M is one example of a second storage chamber, and the ink chamber 61 of each cartridge 60C, 60Y is one example of a third storage chamber. Each nozzle 33B for ejecting the black ink is one example of a first nozzle, each nozzle 33M for ejecting the magenta ink is one example of a second nozzle, and each nozzle 33C for ejecting the cyan ink and each nozzle 33Y for ejecting the yellow ink are one example of a third nozzle.

Drive-Force Transmitting Mechanism 80

The printer 10 further includes a drive-force transmitting mechanism 80 as shown in FIG. 4. The drive-force transmitting mechanism 80 transmits a drive force of the conveyance motor 102 to the supply roller 23, the conveyance rollers 25, and the discharge rollers 27. The drive-force transmitting mechanism 80 is constituted by a combination of all of or a part of gears, pulleys, an endless looped belt, a planetary gear mechanism (pendulum gear mechanism), a one-way clutch, and other similar components.

Controller 130

As shown in FIG. 4, the controller 130 includes a CPU 131, a ROM 132, a RAM 133, an EEPROM 134, and an ASIC 135 that are connected to each other by an internal bus 137. The ROM 132 stores programs and the like executed by the CPU 131 to control various operations of the printer 10. The RAM 133 is utilized as a work area for data processing or a storage area for temporarily storing data, signals, etc., utilized by the CPU 131 to execute the programs. The EEPROM 134 stores setting information to be retained even after the printer 10 is turned off. The ROM 132, the RAM 133, and the EEPROM 134 are one example of a memory.

The conveyance motor 102 and the carriage motor 103 are connected to the ASIC 135. The controller 130 supplies a drive current to the motors 102, 103 via the ASIC 135, so that the motors 102, 103 are forwardly or reversely rotated. Further, the controller 130 applies, to the drive elements of the recording head 32, the drive voltage held by the power supply circuit 45 so as to cause the ink droplets to be ejected from the nozzles 33.

The carriage sensor 35 is connected to the ASIC 135. The controller 130 counts the number of pulse signals output from the carriage sensor 35 and identifies a current position of the carriage 31. A position of the carriage 31 at a current time point (i.e., current position of the carriage 31) will be hereinafter represented as an encoder count (enc). Specifically, as shown in FIG. 8, the encoder count at a right end in a movable range of the carriage 31 and the encoder count at a left end in the movable range of the carriage 31 are respectively represented as 0 (enc) and 2500 (enc). The EEPROM 134 stores the encoder count indicative of the current position of the carriage 31, specifically, the current position of the encoder sensor 35A.

The controller 130 increases the encoder count stored in the EEPROM 134 in accordance with the number of pulse signals output from the carriage sensor 35 during the leftward movement of the carriage 31. On the other hand, the controller 130 decreases the encoder count stored in the EEPROM 134 in accordance with the number of pulse signals output from the carriage sensor 35 during the rightward movement of the carriage 31. In other words, the encoder count stored in the EEPROM 134 increases with an increase in a distance by which the carriage 31 moves leftward while the encoder count stored in the EEPROM 134 decreases with an increase in a distance by which the carriage 31 moves rightward.

A temperature sensor 46 and the mount sensors 53 are connected to the controller 130. The controller 130 identifies an ambient temperature of the printer 10 (hereinafter referred to as an environmental temperature) via the temperature sensor 46. The temperature sensor 46 may be installed on the recording portion 30 or may be attached to the cartridge holder 50, for instance. The controller 130 determines whether the cartridge 60 is mounted on the cartridge holder 50 based on a mount signal output from the corresponding mount sensor 53. Specifically, the controller 130 determines that the cartridge 60 is mounted on the cartridge holder 50 when the mount signal changes from the high-level signal to the low-level signal. The controller 130 determines that the cartridge 60 is withdrawn from the cartridge holder 50 when the mount signal changes from the low-level signal to the high-level signal.

The EEPROM 134 stores an ejection condition table shown in FIG. 5A. The ejection condition table is set by a printer maker at the time of manufacture of the printer 10, for instance. The ejection condition table may be stored in the ROM 132 instead of the EEPROM 134. The ejection condition table includes at least one ejection condition record. The ejection condition record includes a viscosity value, a target voltage value, and ejection timing information, for instance.

The viscosity value is a value indicative of a level of the viscosity of the black ink stored in the cartridge 60B. In the present embodiment, there are set "viscosity 1" as a range of the viscosity lower than a first viscosity, "viscosity 2" as a range of the viscosity from not lower than the first viscosity to lower than a second viscosity that is higher than the first viscosity, and "viscosity 3" as a range of the viscosity not lower than the second viscosity. The three viscosity ranges have the following relationship: viscosity 1<viscosity 2<viscosity 3. The target voltage value is a value indicative of a level of the drive voltage held by the power supply circuit 45. That is, the target voltage value increases with an increase in the viscosity of the black ink. The ejection timing information is information indicative of an ink ejection timing from the nozzles 33 (hereinafter referred to as an ejection timing). In other words, the ejection timing is a timing of application of the drive voltage to the drive elements.

The ejection timing will be explained referring to FIG. 8. The ejection timing specifies, by the encoder count, each nozzle 33 ejects the ink how long before reaching right above the target position of the sheet 12 (e.g., a position at 2000 enc in FIG. 8). That is, the controller 130 adds or subtracts the encoder count corresponding to a distance between each of the nozzles 33B, 33M, 33C, 33Y and the encoder sensor 35A in the right-left direction 9 to or from the ejection timing of each of the nozzles 33B, 33M, 33C, 33Y identified in the ejection condition table, and identifies the position of the carriage 31 at which the ink is to be ejected from each of the nozzles 33B, 33M, 33C, 33Y.

For instance, "The ink to be landed on the target position (2000 enc) of the sheet 12 during the leftward movement of the carriage 31 is ejected from the nozzles 33B, 33M, 33Y at a first timing (e.g., 10 enc before the target position)" means that the magenta ink is ejected at a timing when the nozzles 33M reach a position represented as 1990 (enc), the yellow ink is ejected at a timing when the nozzles 33Y reach the position represented as 1990 (enc) after a further leftward movement of the carriage 31, and the black ink is ejected at a timing when the nozzles 33B reach the position represented as 1990 (enc) after a still further leftward movement of the carriage 31. In other words, the ejection timing according to the present embodiment refers not to a relationship between the position of the carriage 31 and the target position but to a relationship between each of the nozzles 33B, 33M, 33Y and the target position.

The ejection timing information in the table of FIG. 5A specifies, by the encoder count of the carriage sensor 35, a difference between: the ejection timing when the target voltage value is 24 V (hereinafter referred to as "reference timing" where appropriate); and a timing at which certain ink is ejected under a certain condition. That is, the ejection timing information "+1" means that the ink is ejected at a timing later than the reference timing (e.g., 1990 enc) by 1 (enc), namely, at a timing when the nozzles 33 reach a position represented as 1991 enc. The value indicated by the encoder count as the ejection timing information in the table of FIG. 5A differs depending on the ink color. Specifically, for the ink of the color whose rate of change in viscosity is higher, the value indicated by the encoder count is smaller, that is, a deviation from the reference timing is smaller. For the ink of the color whose rate of change in viscosity is lower, the value indicated by the encoder count is larger, that is, the deviation from the reference timing is larger.

The EEPROM 134 stores a history list shown in FIG. 5B. The history list may contain at least one history record. Specifically, the history list does not contain any history record at the time of shipment of the printer 10. The controller 130 adds the history record to the history list at S18 (FIG. 6) later explained. That is, the history record is added to the history list every time an image recording operation is executed.

The history record includes discharge-time information, the number of pages, and an environmental temperature value. The discharge-time information indicates a time of execution of the image recording operation, e.g., year, month, day, hour, and minutes as shown in the list of FIG. 5B. (Hereinafter, the time will be referred to as an ink discharge time). The number of pages indicates the number of the sheets 12 on which an image is recorded in the image recording operation. The number of pages is one example of information about an ink amount discharged from the nozzles 33B. The environmental temperature value indicates the environmental temperature at the time when the image recording operation is executed. In other words, the history record indicates a status of previously executed image recording operations (such as the ink ejection amount and the environmental temperature).

It is, however, noted that the history record may be added at a timing other than the timing of execution of the image recording operation. For instance, when a flushing operation for discharging the ink from the recording head 32 to an ink receiver (not shown) or a purging operation for sucking the ink from the recording head 32 by a pump (not shown) is performed for maintenance of the recording portion 30, the controller 130 may add, to the history list, the history record indicating the ink amount ejected in the flushing operation or the purging operation.

Image Recording Operation

Figure 6:
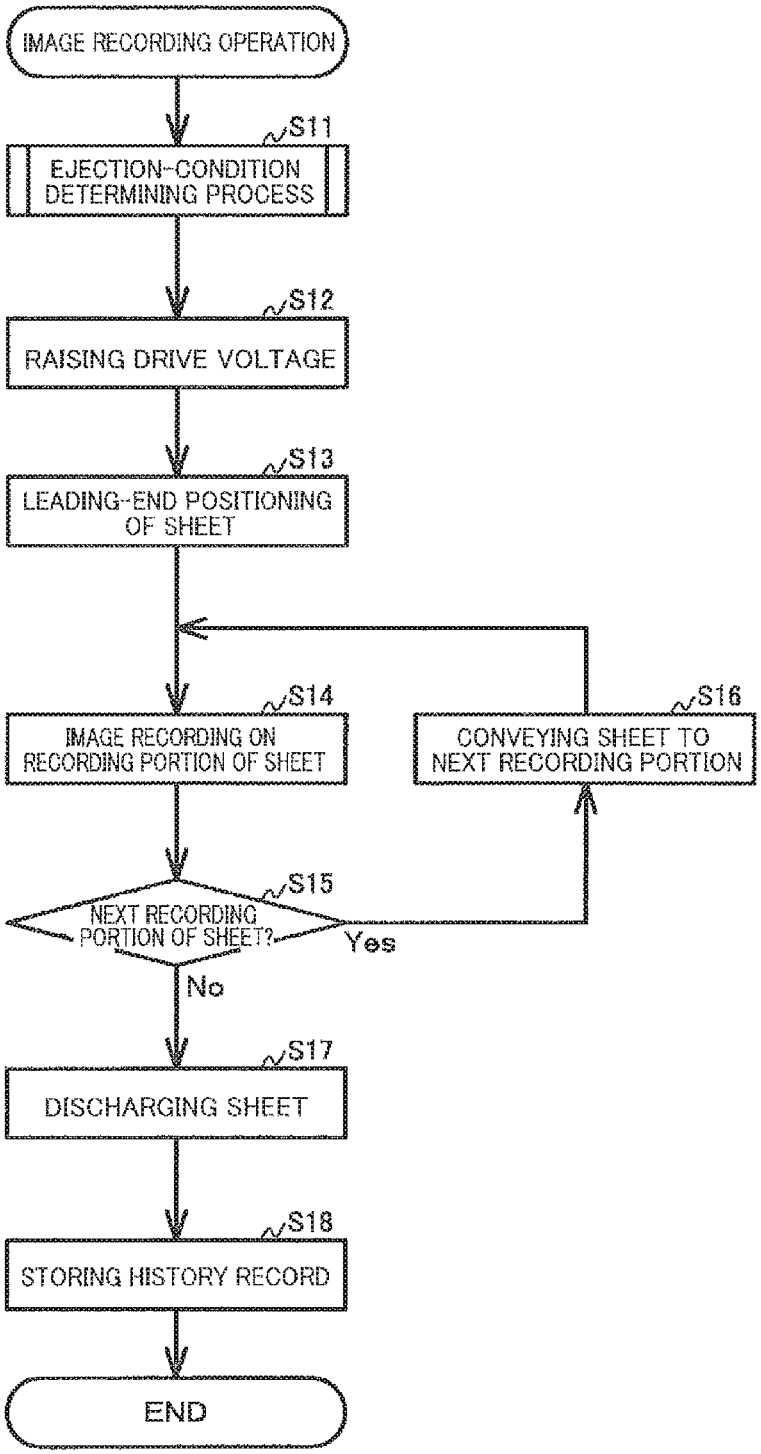
FIG. 6 is a flowchart indicating an image recording operation.
Figure 7:
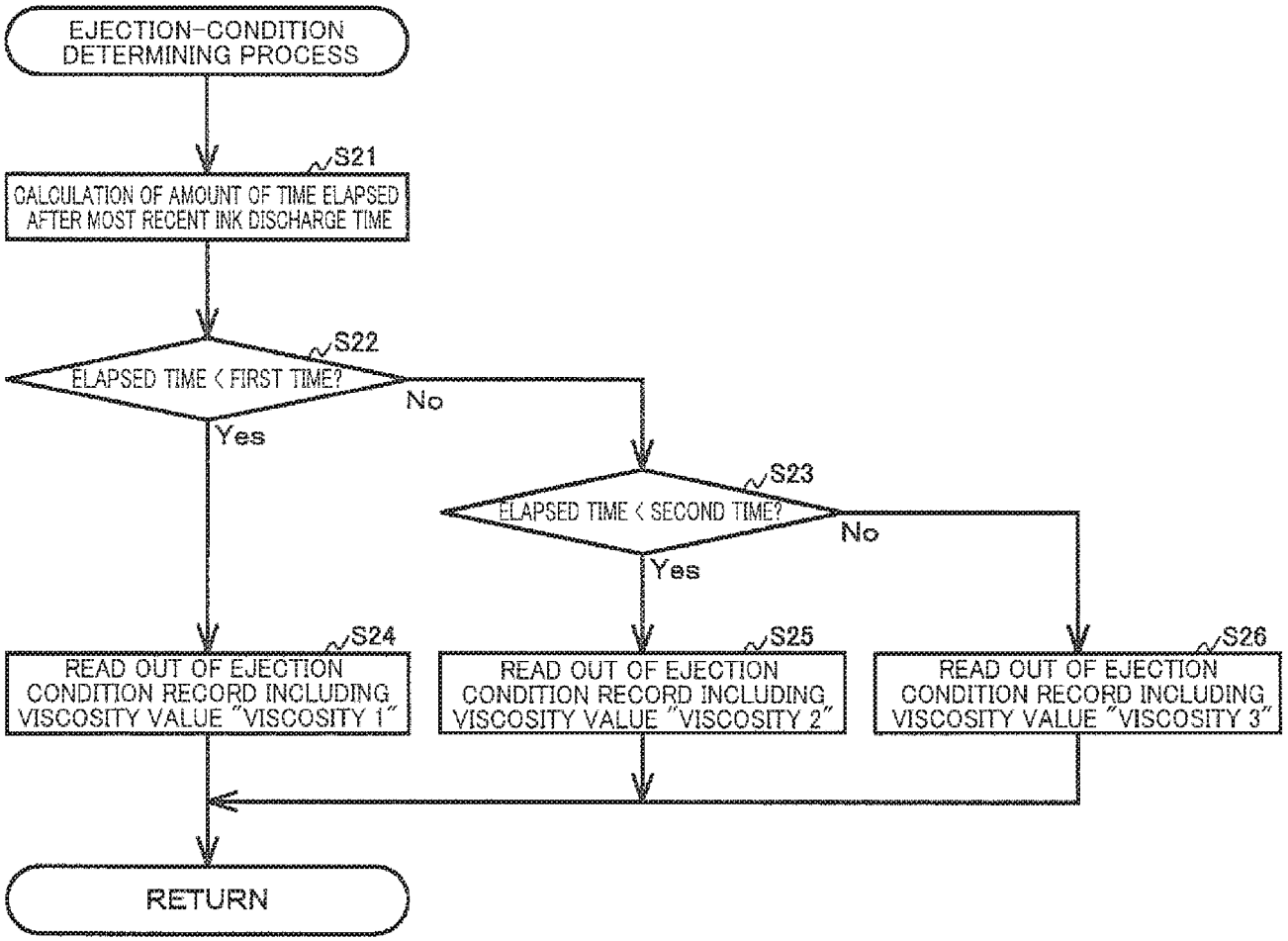
FIG. 7 is a flowchart indicating an ejection-condition determining process.

Referring next to FIGS. 6 and 7, there will be explained the image recording operation executed by the printer 10 of the present embodiment. The following processes in the image recording operation may be executed by the CPU 131 by reading the programs stored in the ROM 132 or may be executed by a hardware circuit mounted on the controller 130. The order of execution of the following processes may be changed without departing from the scope of the present disclosure.

For example, the controller 130 starts the image recording operation in response to reception of a print instruction command from an information processing apparatus via a communication interface (not shown), so as to record, on the sheet 12, an image contained in the print instruction command. As another example, the controller 130 starts the image recording operation in response to acceptance of a copy instruction command from a user via an operation panel (not shown), so as to record, on the sheet 12, an image indicated by image data formed by a scanner (not shown).

Initially, the controller 130 executes an ejection-condition determining process (S11). The ejection-condition determining process is for determining a condition under which the recording head 32 ejects the ink at S14 that will be later explained. Specifically, the ejection-condition determining process is for determining an ejection condition record corresponding to the viscosity of the black ink among a plurality of ejection condition records included in the ejection condition table of FIG. 5A. Referring to a flowchart of FIG. 7, the ejection-condition determining process will be explained in detail.

Ejection-Condition Determining Process

The controller 130 calculates an amount of time elapsed after the ink has been most recently discharged (i.e., elapsed time) (S21). Specifically, the controller 130 reads out, from the EEPROM 134, the history record that has been most recently added to the history list. Further, the controller 130 obtains, from a system clock (not shown), current-time information indicative of a current time. The controller then subtracts the ink discharge time indicated by the discharge-time information in the read history record from the current time indicated by the current-time information, so as to calculate the elapsed time. The process at S21 is one example of a calculating process.

The controller 130 then compares the elapsed time calculated at S21 and predetermined first and second times (S22, S23). The first time is shorter than the second time. The sedimentation of the ink in the cartridge 60 proceeds in a time period during which the ink is not ejected from the recording head 32. That is, it is estimated that the viscosity of the ink is higher in the case where the elapsed time after the most recent ink discharge is longer, in other words, the longer the elapsed time, the higher the viscosity of the ink. The processes at S22, S23 are one example of an estimating process.

In other words, when the elapsed time is shorter than the first time (S22: Yes), the controller 130 estimates that the viscosity of the black ink in the cartridge 60B mounted on the cartridge holder 50 is lower than the first viscosity, in other words, the viscosity of the black ink is "viscosity 1". When the elapsed time falls in a range from not shorter than the first time to shorter than the second time (S22: No & S23: Yes), the controller 130 estimates that the viscosity of the black ink is equal to or higher than the first viscosity and lower than the second viscosity, in other words, the viscosity of the black ink is "viscosity 2". When the elapsed time is not shorter than the second time (S22: No & S23: No), the controller 130 estimates that the viscosity of the black ink is not lower than the second viscosity, in other words, the viscosity of the black ink is "viscosity 3".

Next, the controller 130 reads out, from the EEPROM 134, the ejection condition record corresponding to the viscosity of the black ink estimated at S22, S23 among the plurality of ejection condition records included in the ejection condition table (S24-S26). In other words, the controller 130 determines the target voltage value and the ejection timing information based on the viscosity of the black ink estimated at S22, S23. The processes at S24-S26 are one example of a determining process.

That is, when the viscosity of the black ink is estimated to be "viscosity 1" (S22: Yes), the controller 130 reads out ejection condition record including the viscosity value "viscosity 1" (S24). When the viscosity of the black ink is estimated to be "viscosity 2" (S22: No & S23: Yes), the controller 130 reads out the ejection condition record including the viscosity value "viscosity 2" (S25). When the viscosity of the black ink is estimated to be "viscosity 3" (S22: No & S23: No), the controller 130 reads out the ejection condition record including the viscosity value "viscosity 3" (S26).

Returning back to the flow chart of FIG. 6, the controller 130 raises the drive voltage held by the power supply circuit 45 to the target voltage value in the ejection condition record read out at S24-S26 (S12). For instance, the controller 130 raises the power supply voltage supplied from the external power source up to the target voltage value by the regulator circuit of the power supply circuit 45, and raised drive voltage is held by the capacitor. Raising the drive voltage means that electric charge corresponding to the target voltage value is stored in the capacitor, for instance. After the electric charge corresponding to the target voltage value is stored in the capacitor, the regulator circuit continuously applies, to the capacitor, a voltage for keeping the drive voltage. The process at S12 is one example of a drive-voltage raising process.

Subsequently, the controller 130 conveys the sheet 12 supported on the sheet-supply tray 15 to a position at which a recording portion of the sheet 12 on which an image is to be first recorded is opposed to the recording head 32 (S13). (This recording portion may be referred to as a leading end portion of the sheet 12.) Specifically, the controller 130 controls the supply roller 23 to convey the sheet 12 supported on the sheet-supply tray 15 to a position at which the sheet 12 comes into contact with the conveyance rollers 25. The controller 130 then controls the conveyance rollers 25 to convey the sheet 12 contacting the conveyance rollers 25 to the position at which the recording portion of the sheet 12 is opposed to the recording head 32.

Thereafter, the controller 130 controls the recording head 32 to record an image on the recording portion (the leading end portion) of the sheet 12 that is opposed to the recording head 32 (S14). For instance, during the leftward movement of the carriage 31, the controller 130 causes inks of different colors that constitute each of a plurality of pixels indicated by image data to be selectively ejected from the nozzles 33 toward the target position corresponding to the pixel. The controller 130 causes the inks that should be landed on the target position of the sheet 12 to be ejected from the nozzles 33 according to the ejection timing information in the ejection condition record read out at S24-S26. Referring to FIGS. 5A and 8, there will be explained timings of ejection of the inks to be landed on the target position (2000 enc) from the nozzles 33B, the nozzles 33M, and the nozzles 33Y for each of three target voltage values shown in the table of FIG. 5A. It is noted that the ejection timing of the nozzles 33C is identical to that of the nozzles 33Y and its detailed explanation is dispensed with.

In the case where the target voltage value is determined to be 24 V, the controller 130 applies the drive voltage to the drive elements of the respective nozzles 33B, 33M, 33Y at a timing 10 (enc) before the nozzles 33B, 33M, 33Y reach the target position, i.e., at 1990 enc. That is, when the carriage 31 moves leftward, the controller 130 causes the inks to be ejected from the nozzles 33M, the nozzles 33Y, and the nozzles 33B in this order. The target voltage value in this case (=24 V) is one example of a first voltage value. The ejection timing for the nozzles 33B, 33M, 33Y in this case is one example of a first timing. That is, "The inks are ejected from the nozzles 33B, 33M, 33Y at the first timing" does not mean that the inks are concurrently ejected from the nozzles 33B, 33M, 33Y but means that the respective inks corresponding to the nozzles 33B, the nozzles 33M, and the nozzles 33Y are ejected respectively at the timing when each of the nozzles 33B, the nozzles 33M, and the nozzles 33Y reach the position 10 (enc) before the target position.

In the case where the target voltage value is determined to be 25 V, the controller 130 does not change the ejection timing of the nozzles 33B, delays the ejection timing of the nozzles 33M by 1 (enc), and delays the ejection timing of the nozzles 33Y by 2 (enc), with respect to the first timing as the reference timing. That is, the controller 130 applies the drive voltage to the drive elements corresponding to the nozzles 33B at the timing when the nozzles 33B reach the position represented as 1990 (enc), applies the drive voltage to the drive elements corresponding to the nozzles 33M at a timing when the nozzles 33M reach a position represented as 1991 (enc), and applies the drive voltage to the drive elements corresponding to the nozzles 33Y when the nozzles 33Y reach a position represented as 1992 (enc). The target voltage value in this case (=25 V) is one example of a second voltage value. The ejection timing of the nozzles 33B in this case is one example of the first timing, the ejection timing of the nozzles 33M in this case is one example of a second timing, and the ejection timing of the nozzles 33Y in this case is one example of a fourth timing.

In the case where the target voltage value is determined to be 26 V, the controller 130 does not change the ejection timing of the nozzles 33B, delays the ejection timing of the nozzles 33M by 2 (enc), and delays the ejection timing of the nozzles 33Y by 4 (enc), with respect to the first timing That is, the controller 130 applies the drive voltage to the drive elements corresponding to the nozzles 33B when the nozzles 33B reach the position represented as 1990 (enc), applies the drive voltage to the drive elements corresponding to the nozzles 33M when the nozzles 33M reach the position represented as 1992 (enc), and applies the drive voltage to the drive elements corresponding to the nozzles 33Y when the nozzles 33Y reach a position represented as 1994 (enc). The target voltage value in this case (=26 V) is one example of a third voltage value. The ejection timing of the nozzles 33B in this case is one example of the first timing, the ejection timing of the nozzles 33M in this case is one example of a third timing, and the ejection timing of the nozzles 33Y in this case is one example of a fifth timing.

In the case where another recording portion of the sheet 12 on which an image is to be next recorded (i.e., a next recording portion of the sheet 12) exists (S15: Yes), the controller 130 controls the conveyance rollers 25 and the discharge rollers 27 to convey the sheet 12 to a position at which the next recording portion is opposed to the recording head 32 (S16). The controller 130 repeatedly executes the processes at S14-S16 until an image is recorded on an entire recording region of the sheet 12 (S15: Yes). When an image is recorded on the entire recording region of the sheet 12 (S15: No), the controller 130 controls the discharge rollers 27 to discharge the sheet 12 to the sheet-discharge tray 16 (S17). In the case where an image is recorded on a plurality of pages in one image recording operation, the controller 130 repeatedly executes the processes at S13-S17.

Subsequently, the controller 130 adds, to the history list, the history record containing information as to the image recording operation (S18). Specifically, the controller 130 obtains, from the system clock (not shown), the current-time information as the discharge-time information, counts the number of executions of S13-S17 as the number of pages, and obtains the environmental temperature value from the temperature sensor 46. The controller 130 then adds, to the history list, the history record containing the discharge-time information, the number of pages, and the environmental temperature value obtained as described above. The process at S18 is one example of a storage process.

Advantageous Effects

According to the illustrated embodiment, the level of the drive voltage is adjusted in accordance with the viscosity of the black ink, so that the ejection speed of the black ink is equalized. That is, the ejection timing of the black ink from the nozzles 33B is always the first timing irrespective of the level of the estimated viscosity. On the other hand, the viscosity of the magenta ink, the viscosity of the cyan ink, and the viscosity of the yellow ink are not the same as the black ink. If the drive voltage whose level is adjusted in accordance with the viscosity of the black ink is applied to the drive elements respectively corresponding to the nozzles 33M, 33C, 33Y, the magenta ink, the cyan ink, and the yellow ink are ejected at respective speeds higher than desired.

In the present embodiment, the timing of application of the drive voltage to the drive elements corresponding to the nozzles 33M, the timing of application of the drive voltage to the drive elements corresponding to the nozzles 33C, and the timing of application of the drive voltage to the drive elements corresponding to the nozzles 33Y are delayed, whereby a deviation of the ink landing position from the target position due to the change in the viscosity can be appropriately adjusted for each of the inks of different colors. The number of ejection condition records included in the ejection condition table is not limited to three. The deviation of the ink landing position due to the change in the viscosity can be more appropriately adjusted for each of the inks of different colors with an increase in the number of ejection condition records. The target voltage value and the ejection timing may be determined by substituting the viscosity value into a given function, instead of referring to the table described above.

According to the illustrated embodiment, the landing position of the black ink whose rate of change in the viscosity is high is adjusted by adjusting the level of the drive voltage, and the landing positions of the magenta ink, the cyan ink, and the yellow ink whose rates of change in the viscosity are lower than the black ink are adjusted by adjusting the respective timings of application of the drive voltage. Thus, this configuration prevents or reduces a failure of ejection, from the nozzles 33B, of the black ink having the highest viscosity due to ejection energy shortage. It is noted that the landing positions of the inks other than the black ink may be adjusted by adjusting the level of the drive voltage to be applied.

As a modification, the controller 130 may estimate the viscosity of the magenta ink and may determine the target voltage value based on the estimated viscosity. In the case where the controller 130 determines the target voltage value to be 24 V, the controller 130 may determine the ejection timings of all of the inks to be a first timing. In the case where the controller 130 determines the target voltage value to be 25 V, the controller 130 may determine the ejection timing of the magenta ink to be the first timing, may determine the ejection timing of the black ink to be a second timing earlier than the first timing, and may determine the ejection timings of the cyan ink and the yellow ink to be a third timing later than the first timing. That is, the ejection timing of any one of the inks may be fixed, and the ejection timings of the rest of the inks may be adjusted in accordance with the level of the drive voltage.

As another modification, in the case where the controller 130 determines the target voltage value to be 24 V, the controller 130 may determine the ejection timings of all of the inks to be a first timing. In the case where the controller 130 determines the target voltage value to be 25 V, the controller 130 may determine the ejection timing of the black ink to be a second timing earlier than the first timing, may determine the ejection timing of the magenta ink to be a third timing later than the first timing, and may determine the ejection timings of the cyan ink and the yellow ink to be a fourth timing later than the third timing. That is, the drive voltage and the ejection timings of all of the inks may be both adjusted. According to this configuration, the level of the drive voltage is adjusted based on the viscosity of the black ink, and the ejection timing of the black ink is advanced with respect to the reference timing while the ejection timings of the other inks are delayed with respect to the reference timing. Thus, the deviation of the ink landing position from the target position due to the change in the viscosity is appropriately corrected for each of the inks of different colors.

The sedimentation of the black ink proceeds with an increase in a period during which the ink is not ejected from the nozzles 33, namely, with an increase in the elapsed time calculated at S21. It is accordingly desirable to estimate that the viscosity of the black ink is higher in the case where the elapsed time is longer, as in the configuration described above. The ink viscosity may be estimated otherwise. As still another modification, the controller 130 may calculate a cumulative total of the number of pages by adding up the number of pages in the history records that have been recorded in a predetermined period (e.g., for one month)

going back from the current time point to a certain time point that precedes the current time point, among a plurality of history records recorded in the history list. In this case, the controller 130 may estimate that the viscosity of the black ink is higher in the case where the calculated cumulative total of the number of pages is smaller, in other words, the smaller the calculated cumulative total of the number of pages, the higher the viscosity of the black ink. That is, it is desirable to estimate that the viscosity of the black ink is higher in the case where the amount of discharged black ink is smaller.

As yet another modification, the controller 130 may obtain the environmental temperature value from the temperature sensor 46 at S21. In this case, the controller 130 may estimate that the viscosity of the black ink is higher in the case where the environmental temperature obtained at S21 is lower. As still yet another modification, the controller 130 may calculate a representative value of the environmental temperature values in the history records in a predetermined period (e.g., for one month) going back from the current time point to a certain time point that precedes the current time point, among a plurality of history records recorded in the history list. In this case, the controller 130 may estimate that the viscosity of the black ink is higher in the case where the calculated representative environmental temperature value is lower, in other words, the lower the calculated representative environmental temperature value, the higher the viscosity of the black ink. Here, examples of the representative environmental temperature value include an average value, a modal value, and a median, of a plurality of environmental temperature values. The sedimentation speed of the ink becomes higher with a decrease in the environmental temperature value. It is thus desirable to estimate the ink viscosity based on the environmental temperature at the time of estimation of the viscosity or based on the representative environmental temperature value in the predetermined period as in the modification described above.

As further modification, the controller 130 may estimate that the viscosity of the black ink is higher in the case where the elapsed time after mounting of the cartridge 60B on the cartridge holder 50 is longer, in other words, the longer the elapsed time after mounting of the cartridge 60B on the cartridge holder 50, the higher the viscosity of the black ink. Specifically, in response to detection of the mounting of the cartridge 60B on the cartridge holder 50 by the mount sensor 53, the controller 130 may store, in the EEPROM 134, the current-time information obtained from the system clock as mounting-time information indicative of a time of mounting (mounting time). In this case, the controller 130 may calculate, as the elapsed time, a difference between the current time indicated by the current-time information obtained from the system clock at S21 and the mounting time indicated by the mounting-time information stored in the EEPROM 134.

A user's manual of the printer 10 generally says that "Shake cartridges before mounting on the cartridge holder". That is, the black ink in the cartridge 60B upon mounting on the cartridge holder 50 is in a stirred state, and the sedimentation proceeds with time. It is thus desirable to estimate the viscosity of the black ink based on the elapsed time after mounting of the cartridge 60B on the cartridge holder 50 as in the modification described above.

The present disclosure offers prominent advantages especially when applied to the printer 10 on which is mountable the cartridge 60 having the ink chamber 61 whose volume is large, i.e., a large-volume cartridge. It is noted, however, that the ink may be supplied to the recording head 32 from other than the cartridge 60. For instance, in place of the cartridge holder 50, the printer 10 may include an ink tank fixed to the housing 14 such that the ink tank is not easily detached. In this case, an inner space of the ink tank is one example of the storage chamber that stores ink, and the inner space of the ink tank and the recording head 32 communicate with each other through the ink tube 41. Here, "The ink tank is not easily detached" means that an ordinary user cannot easily detach the ink tank from the printer 10 in an ordinary use condition, for instance. It is not necessarily required that the ink tank cannot be detached from the printer 10.

In the illustrated embodiment, the supply roller 23, the conveyance rollers 25, and the discharge rollers 27 are rotated by the drive force of the conveyance motor 102. A supply motor for rotating the supply roller 23 may be provided in addition to the conveyance motor 102.

What is claimed is:

1. An ink-jet recording apparatus, comprising:

a recording head including (a) nozzles each of which communicates with a corresponding one of storage chambers that respectively store inks and (b) energy generating elements each of which generates an ejection energy for causing the ink stored in a corresponding one of the storage chambers to be ejected through a corresponding one of the nozzles;

a carriage on which the recording head is mounted and which reciprocatingly moves in a main scanning direction;

a power supply circuit configured to hold a drive voltage which is common to all of the energy generating elements and which is to be applied to each of the energy generating elements for generating the ejection energy; and a controller, wherein the storage chambers include a first storage chamber storing a first ink and a second storage chamber storing a second ink, a rate of change in a viscosity of the second ink being different from a rate of change in a viscosity of the first ink, wherein the nozzles include a first nozzle communicating with the first storage chamber and a second nozzle communicating with the second storage chamber, wherein the controller executes:

an estimating process to estimate the viscosity of the first ink stored in the first storage chamber;

a determining process to determine, based on the viscosity estimated in the estimating process, a voltage value of the drive voltage held by the power supply circuit and a timing of application of the drive voltage to each of the energy generating elements for causing the ink to land on a target position of a sheet;

a drive-voltage raising process to raise the drive voltage held by the power supply circuit to the voltage value determined in the determining process; and an ejecting process to apply, to each of the energy generating elements, the drive voltage raised in the drive-voltage raising process at the timing determined in the determining process during the movement of the carriage in the main scanning direction, wherein, in the determining process, when the viscosity estimated in the estimating process is lower than a first viscosity, the controller determines the voltage value of the drive voltage to be a first voltage value and determines the timing of application of the drive voltage to the energy generating element corresponding to the first nozzle and the timing of application of the drive voltage to the energy generating element corresponding to the second nozzle to be a first timing, and when the viscosity estimated in the estimating process is equal to or higher than the first viscosity, the controller determines the voltage value of the drive voltage to be a second voltage value higher than the first voltage value, determines the timing of application of the drive voltage to the energy generating element corresponding to the first nozzle to be the first timing, and determines the timing of application of the drive voltage to the energy generating element corresponding to the second nozzle to be a second timing different from the first timing.

2. The ink-jet recording apparatus according to claim 1, wherein the rate of change in the viscosity of the second ink is lower than the rate of change in the viscosity of the first ink, and wherein the second timing is later than the first timing.

3. The ink-jet recording apparatus according to claim 2, wherein, in the determining process, when the viscosity estimated in the estimating process is equal to or higher than the first viscosity and lower than a second viscosity that is higher than the first viscosity, the controller determines the voltage value of the drive voltage to be the second voltage value, determines the timing of application of the drive voltage to the energy generating element corresponding to the first nozzle to be the first timing, and determines the timing of application of the drive voltage to the energy generating element corresponding to the second nozzle to be the second timing, and when the viscosity estimated in the estimating process is equal to or higher than the second viscosity, the controller determines the voltage value of the drive voltage to be a third voltage value higher than the second voltage value, determines the timing of application of the drive voltage to the energy generating element corresponding to the first nozzle to be the first timing, and determines the timing of application of the drive voltage to the energy generating element corresponding to the second nozzle to be a third timing later than the second timing.

4. The ink-jet recording apparatus according to claim 3, wherein the storage chambers further include a third storage chamber storing a third ink, a rate of change in a viscosity of the third ink being lower than the rate of change in the viscosity of the second ink, wherein the nozzles further include a third nozzle communicating with the third storage chamber, wherein, in the determining process, when the viscosity estimated in the estimating process is lower than the first viscosity, the controller determines a timing of application of the drive voltage to the energy generating element corresponding to the third nozzle to be the first timing, when the viscosity estimated in the estimating process is equal to or higher than the first viscosity and lower than the second viscosity, the controller determines the timing of application of the drive voltage to the energy generating element corresponding to the third nozzle to be a fourth timing later than the second timing, and when the viscosity estimated in the estimating process is equal to or higher than the second viscosity, the controller determines the timing of application of the drive voltage to the energy generating element corresponding to the third nozzle to be a fifth timing later than the third timing.

5. An ink-jet recording apparatus according to claim 1, wherein the controller executes a calculating process to calculate a time elapsed up to a current time point from a time point when the first ink has been most recently discharged through the first nozzle, and wherein the controller estimates in the estimating process that the viscosity of the first ink is higher in the case where the time calculated in the calculating process is longer.

6. The ink-jet recording apparatus according to claim 1, further comprising a memory, wherein the controller executes, in response to execution of the ejecting process, a storage process to store, in the memory, ink amount information indicative of an amount of the first ink ejected through the first nozzle in the ejecting process, and wherein the controller estimates in the estimating process that the viscosity of the first ink is higher in the case where a total value of the ink amounts indicated by the ink amount information stored in a predetermined time period going back from a current time point to a certain time point that precedes the current time point is smaller.

7. The ink-jet recording apparatus according to claim 1, further comprising a temperature sensor for detecting an ambient temperature of the ink-jet recording apparatus, wherein the controller estimates in the estimating process that the viscosity of the first ink is higher in the case where the temperature detected by the temperature sensor when the estimating process is executed is lower.

8. The ink-jet recording apparatus according to claim 1, further comprising:

a memory; and a temperature sensor for detecting an ambient temperature of the ink-jet recording apparatus, wherein the controller executes a storage process to store, in the memory, temperature information indicative of the temperature detected by the temperature sensor when the ejecting process is executed, and wherein the controller estimates in the estimating process that the viscosity of the first ink is higher in the case where a representative value of the temperatures indicated by the temperature information stored in a predetermined time period going back from a current time point to a certain time point that precedes the current time point is lower.

9. The ink-jet recording apparatus according to claim 1, further comprising:

a cartridge holder on which are detachably mounted cartridges in each of which a corresponding one of the storage chambers is formed; and a mount sensor for detecting whether one of the cartridges that stores the first ink is being mounted on the cartridge holder, wherein the controller estimates in the estimating process that the viscosity of the first ink is higher in the case where an amount of time elapsed after the mount sensor detects mounting of the cartridge that stores the first ink on the cartridge holder is longer.

10. An ink-jet recording apparatus, comprising:

a recording head including (a) nozzles each of which communicates with a corresponding one of storage chambers that respectively store inks and (b) energy generating elements each of which generates ejection energy for causing the ink stored in a corresponding one of the storage chambers to be ejected through a corresponding one of the nozzles;

a carriage on which the recording head is mounted and which reciprocatingly moves in a main scanning direction;

a power supply circuit configured to hold a drive voltage which is common to all of the energy generating elements and which is to be applied to each of the energy generating elements for generating the ejection energy; and a controller, wherein the storage chambers include a first storage chamber storing a first ink and a second storage chamber storing a second ink, a rate of change in a viscosity of the second ink being lower than a rate of change in a viscosity of the first ink, wherein the nozzles include a first nozzle communicating with the first storage chamber and a second nozzle communicating with the second storage chamber, wherein the controller executes:

an estimating process to estimate the viscosity of the first ink stored in the first storage chamber;

a determining process to determine, based on the viscosity estimated in the estimating process, a voltage value of the drive voltage held by the power supply circuit and a timing of application of the drive voltage to each of the energy generating elements for causing the ink to land on a target position of a sheet;

a drive-voltage raising process to raise the drive voltage held by the power supply circuit to the voltage value determined in the determining process; and an ejecting process to apply, to each of the energy generating elements, the drive voltage raised in the drive-voltage raising process at the timing determined in the determining process during the movement of the carriage in the main scanning direction, wherein, in the determining process, when the viscosity estimated in the estimating process is lower than a first viscosity, the controller determines the voltage value of the drive voltage to be a first voltage value and determines the timing of application of the drive voltage to the energy generating element corresponding to the first nozzle and the timing of application of the drive voltage to the energy generating element corresponding to the second nozzle to be a first timing, and when the viscosity estimated in the estimating process is equal to or higher than the first viscosity, the controller determines the voltage value of the drive voltage to be equal to a second voltage value higher than the first voltage value, determines the timing of application of the drive voltage to the energy generating element corresponding to the first nozzle to be a second timing earlier than the first timing, and determines the timing of application of the drive voltage to the energy generating element corresponding to the second nozzle to be a third timing later than the first timing.

* * * * *